US007681468B2

(12) United States Patent
Verl et al.

(10) Patent No.: US 7,681,468 B2
(45) Date of Patent: Mar. 23, 2010

(54) TESTING DEVICE FOR TRACKS OF ROLLER COASTERS

(76) Inventors: Alexander Verl, Hofer Str. 27, 71636, Ludwigsburg (DE); Gino De-Gol, 21 Miranda Drive, Heathcote, Warwick CV 346 FE (GB)

( * ) Notice: Subject to any disclaimer, the term of this patent is extended or adjusted under 35 U.S.C. 154(b) by 467 days.

(21) Appl. No.: 11/679,867

(22) Filed: Feb. 28, 2007

(65) Prior Publication Data

US 2007/0227274 A1 Oct. 4, 2007

(30) Foreign Application Priority Data

Feb. 28, 2006 (DE) ..... 10 2006 010 110

(51) Int. Cl.
*G01M 19/00* (2006.01)

(52) U.S. Cl. ..... 73/865.8

(58) Field of Classification Search ..... None
See application file for complete search history.

(56) References Cited

U.S. PATENT DOCUMENTS

2003/0172834 A1* 9/2003 De-Gol ..... 104/53

FOREIGN PATENT DOCUMENTS

JP 2000-61147 * 2/2000

* cited by examiner

*Primary Examiner*—Robert R Raevis
(74) *Attorney, Agent, or Firm*—Gudrun E. Huckett

(57) ABSTRACT

A testing device for roller coaster tracks has a carriage adapted to move along tracks of a roller coaster and at least one multi-axis robot mounted on the carriage. The robot has at least one testing element. The at least one robot has at least six axes and is rotatably supported on the carriage on an axis that is transverse to a plane of the tracks.

22 Claims, 3 Drawing Sheets

TESTING DEVICE FOR TRACKS OF ROLLER COASTERS

BACKGROUND OF THE INVENTION

The invention relates to a testing device for tracks of roller coasters.

It is known that tracks or rails of roller coasters must be continuously monitored and checked for safety reasons. This is done by the personnel operating the roller coaster; the personnel monitor the tracks, particularly the welding seams and the screw connections. This type of monitoring of the tracks or rails of roller coasters is complex and difficult, in particular because monitoring can be carried out only when the roller coaster is not in operation.

SUMMARY OF THE INVENTION

It is an object of the present invention to configure a testing device of the aforementioned kind such that monitoring and examining of the tracks can be done simply and without problems.

In accordance with the present invention, this is achieved in that the testing device comprises a carriage movable along the tracks which carriage has at least one multi-axis robot that is provided with at least one testing element.

By means of the testing device according to the invention, it is possible to automatically monitor and examine the tracks or rails. While the carriage is riding along the tracks, the testing element of the robot monitors or checks the state of the tracks. It is therefore no longer required that the personnel themselves check the tracks. The carriage with the robot can be used during normal operation of the roller coaster or when operation of the roller coaster is interrupted. The carriage in the case of a roller coaster can be, for example, one of the regular cabins in which the robot, in the form of a dummy, is seated. In this way, it is even possible to monitor the state of the tracks continuously. Of course, the carriage can also be an autonomous unit that can move along the tracks outside of the regular operating times of the roller coaster in order to examine and check the tracks.

DESCRIPTION OF THE PREFERRED EMBODIMENTS

Figure 2:
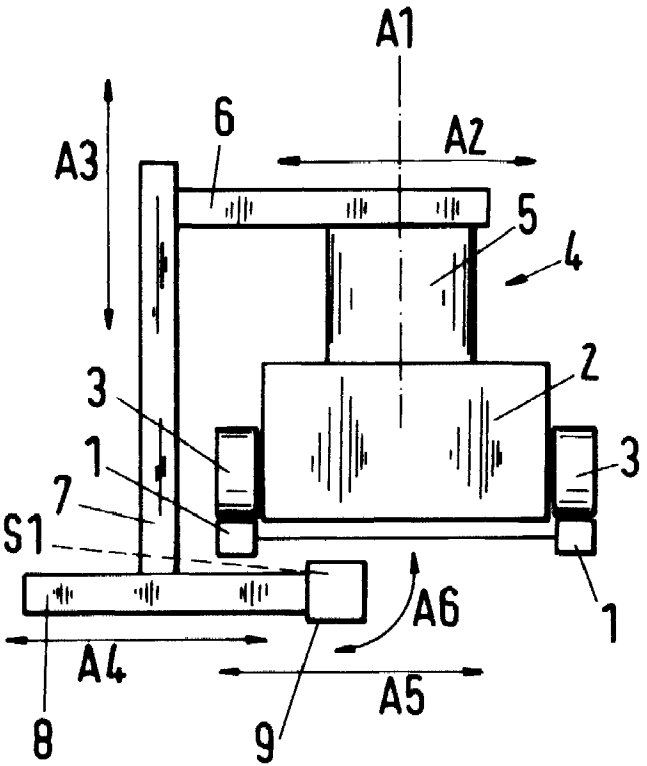
FIG. 2 shows the testing device according to FIG. 1 in a front view.

The testing device is provided for checking or testing tracks (rails) 1 of roller coasters and comprises a carriage 2 movable on wheels 3 on the tracks 1. The carriage 2 is provided with a drive and an energy supply system (not illustrated) so that the carriage 2 can freely move on the tracks 1. The carriage 2 carries a robot 4 with which the roller coaster and in particular its tracks 1 can be checked. The robot 4 has a support body 5 which can be rotatably driven about an axis of rotation A1 that is transverse to and preferably perpendicular to the driving direction of the carriage 2. On the support body 5, a robot arm (support arm) 6 is supported that extends transversely, preferably perpendicularly, to the axis of rotation A1 of the support body 5 and is movable in its longitudinal direction relative to the support body 5 in the direction A2. At the free end of the support arm 6 a robot arm 7 is provided which extends transversely, preferably perpendicularly, to the support arm 6. The robot arm 7 has a length selected such that in the end position illustrated in FIG. 2 it reaches into the area below the tracks 1. The robot arm 7 can be moved relative to the support arm 6 in the direction of axis A3 that is parallel to the axis of rotation A1 of the support body 5. When the support body 5 is rotated such that the support arm 6 is perpendicular to the travel direction of the carriage 2, the robot arm 7 is arranged in the area adjacent to the tracks 1.

At the lower end, the robot arm 7 supports a transverse robot arm 8 that can be moved in its longitudinal direction relative to the robot arm 7 in the direction A4.

At the end of the transverse robot arm 8 that is located below the tracks 1 a testing element (sensor) 9 is provided that can be moved in the direction A5 along the transverse robot arm 8 and is rotatable about an axis A6 that is oriented in the travel direction of the carriage 2. Also, as shown in FIG. 1, the sensor 9 can be rotated about axis A7 that extends perpendicularly to the axis A6 and parallel to the axis of rotation A1 of the support body 5.

In the described embodiment, the robot 4 has seven axes so that it can reach all relevant locations on or below the track 1 by appropriate adjustment of the support body 5, of the robot arms 6 through 8, and of the sensor 9. The drive and energy supply of the robot 4 is arranged on or in the carriage 2.

Figure 1:
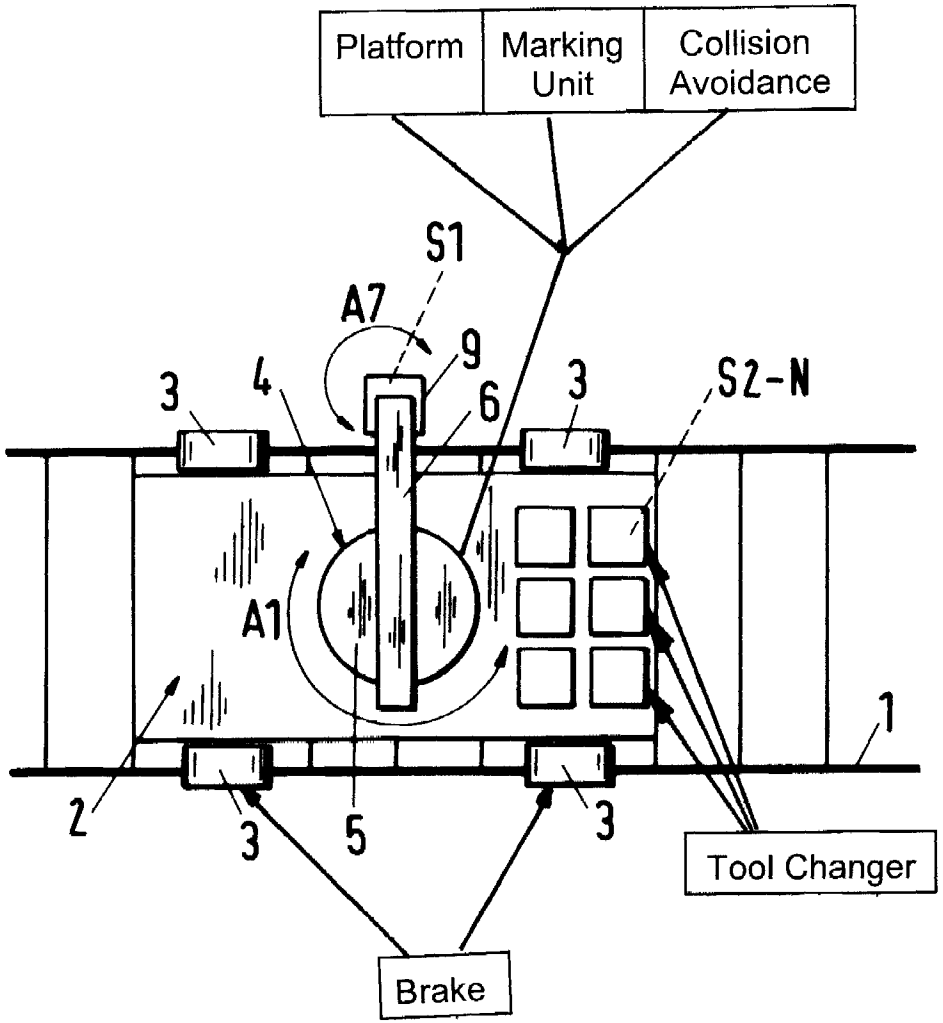
FIG. 1 is a schematic illustration in plan view of the testing device according to the invention.
Figure 1A:
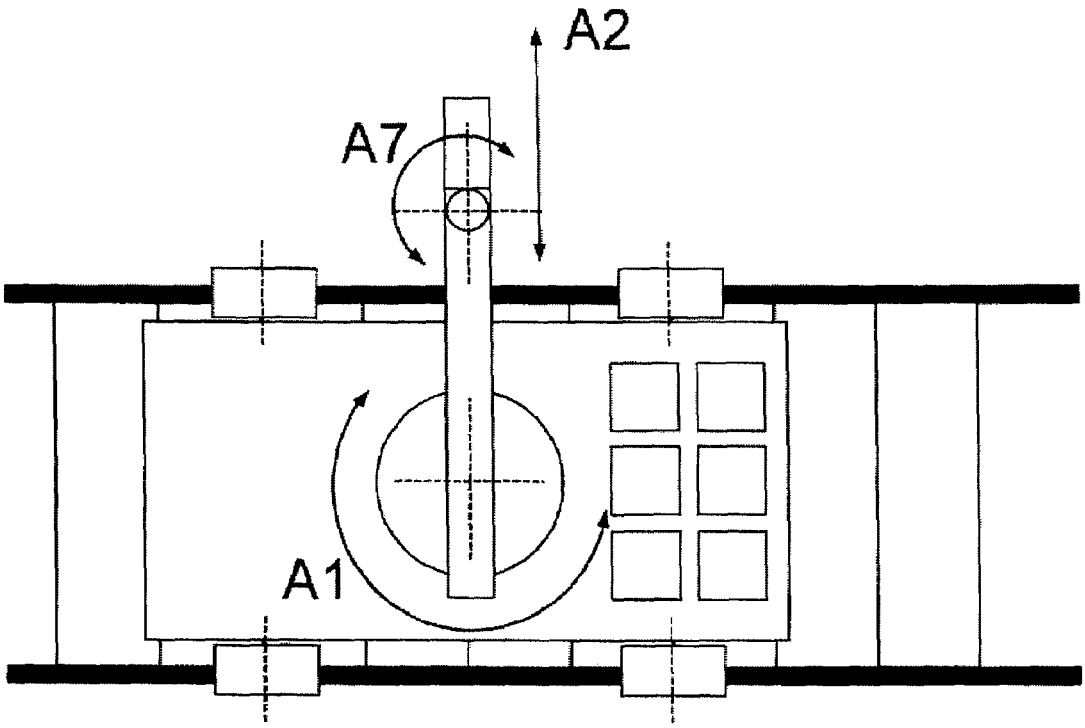
FIG. 1*a* is a schematic illustrating some of the robot axes.
Figure 2A:
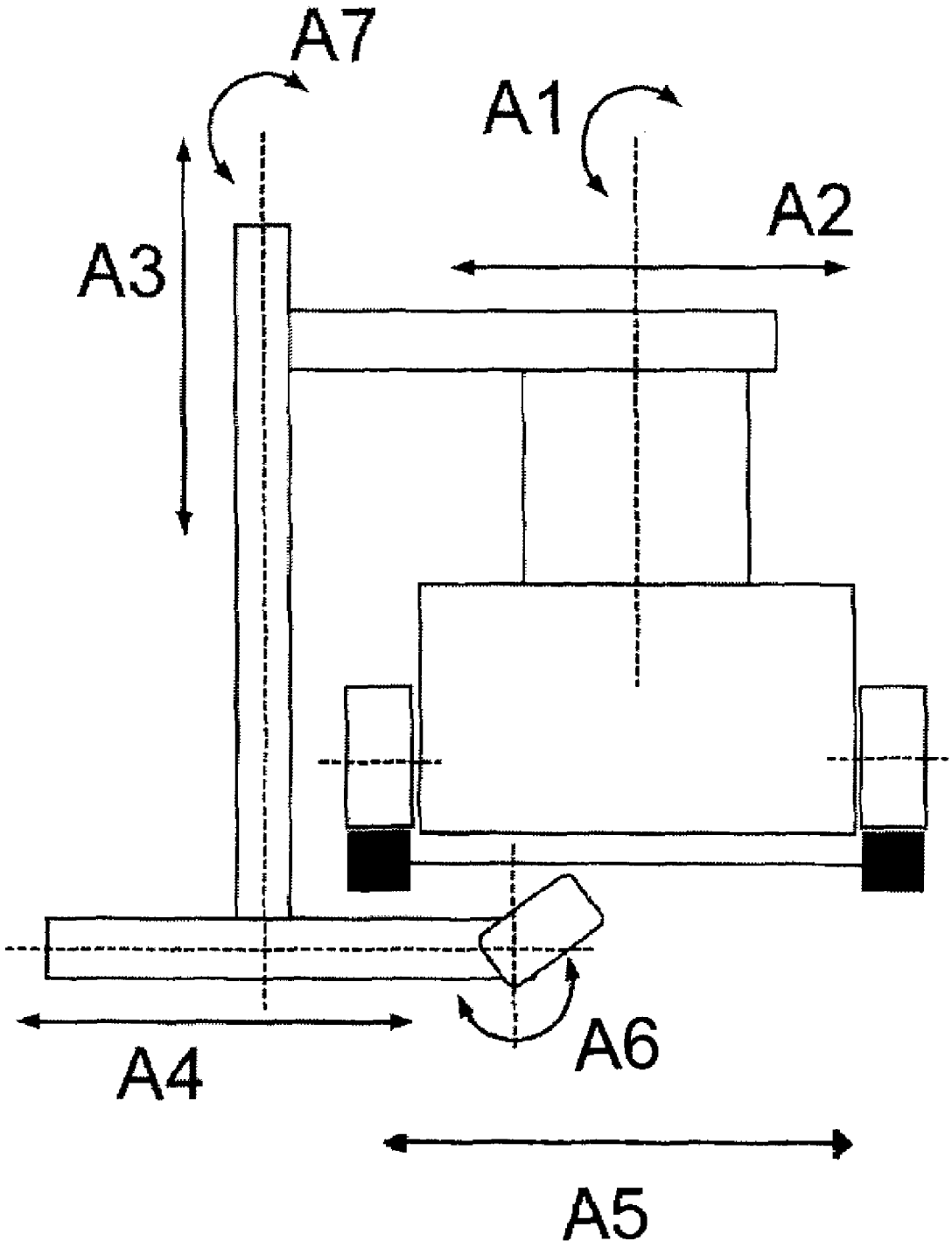
FIG. 2*a* is a schematic illustrating some of the robot axes.

The carriage 2 has several sensors S1 to SN (FIG. 1 shows sensor S1 arranged where aforementioned sensor 9 is located and sensors S2 to SN stored on the carriage 2) that can be attached by means of a tool changer (only schematically illustrated) to the robot 4 or its transverse arm 8. The sensors S1 to SN are provided for carrying out different examination tasks. Depending on the type of employed sensor, different examinations, for example, on welding seams or screw connections of the tracks 1, can be carried out. Depending on the type of sensor, it is possible to employ ultrasound, x-ray, image processing, structure-borne sound and the like as examination methods. Since the sensors S1 to SN are present on the carriage 2, the most beneficial examination method can be used, respectively. By means of the axes A1 to A7, the respective sensor can reach any location on, adjacent to, and underneath the track or rail in order to carry out examinations. Advantageously, the robot 4 communicates wireless with a control station. In this way, a problem-free transmission of sensor signals to the control station is possible in which control station the signals are evaluated. Accordingly, the robot 4 can examine or test the roller coaster in a fully automated fashion.

However, it is also possible to actively remote-control the carriage 2 and the robot 4 from the control station. In this way, the robot 4 can be moved by the control station to certain locations on the roller coaster in order to carry out targeted examinations or tests at the target location. In this so-called telepresence method, the actions can be recorded. It is possible to have the carriage 2 with the robot 4 move along the roller coaster fully automatically and to subsequently move the robot by means of the telepresence method to certain areas of the roller coaster in order to carry out targeted examinations at the target areas. Such a methodology is recommended when after a fully automated inspection there is uncertainty whether certain areas of the roller coaster are at risk or not. In such cases, the robot 4 can move in a targeted fashion to such a location in order to carry out, controlled by the control station, certain examinations. For example, several sensors can be used in order to check this area especially precisely. In this way, the actions that are recorded during the telepresence method can be added to the inspection data that have been recorded or collected during the fully automated inspection operation in order to be able to derive more precise information and conclusions in regard to the critical areas.

Depending on the examination method, the support arm 6 can be operated position-controlled or force-controlled. For position control, the support body 5 and the robot arms 6 to 8 are rotated and/or moved into the desired position in order to carry out by means of the appropriate sensor S1 to SN the desired examination, respectively.

For a fully automated operation of the robot 4, it is necessary that the respective position of the robot on the roller coaster is precisely known so that problematic areas of the roller coaster can be reliably determined again at a later time. For example, it is possible that the carriage 2 with the robot 4 performs a reference ride and, while doing this, records the roller coaster by means of a camera sensor. During inspection operation, the current position is then compared to the position during the reference ride. It is also possible that during the reference ride of the robot 4 characteristic features of the roller coaster and in particular of the tracks or rails 1 are determined by means of sensors. These characteristic features are then saved as reference values. Based on these reference values, during later inspection operation the respective position of the robot 4 on the roller coaster can be determined unequivocally.

In order to prevent that the robot 4 with its arms during inspection operation collides with parts of the roller coaster, the testing device is advantageously provided with sensors that detect obstacles in the movement path of the robot 4 and ensure that collisions are prevented. For example, it is possible to stop the carriage 2 in front of an obstacle and to then position the robot 4 in such a way that it can pass the obstacle without colliding with it. In principle, it is also possible to adjust the robot 4 during the ride of the carriage 2 such that it does not collide with obstacles detected by the sensors. Instead of a sensor-supported collision avoidance device, it is also possible to provide a model-supported collision avoidance device. In this case, a model of the roller coaster is saved in the form of data so that, based on a defined starting point, the robot 4 is adjusted during its inspection operation always in such a way that collisions are prevented. The sensor-supported operation however has the advantage that obstacles that present themselves unexpectedly are detected and collisions are prevented in this way.

In order to be able to stop the carriage at any location on the roller coaster, the carriage is provided with braking brackets that prevent any type of slip between the carriage 2 and the tracks or rails 1. In particular on track sections having a great incline, it is ensured that the carriage 2 can safely be held in position by the brake when the carriage 2 is stopped.

In addition to the sensors S1 to SN, the testing device can also be provided with a marking unit that marks problem locations on the roller coaster. Such a marking unit can be, for example, a lettering system, a spraying head and the like with which problem locations are clearly marked for example by a color.

The robot 4 on the carriage 2 can also be designed such that it has mounted thereon a platform that, like the sensors S1 to SN, can be positioned in any required position. By means of the platform, a workman can be moved to problem locations so that the workman can check or repair this location himself.

It is also possible to provide two or more robots 4 on the carriage 2 that are designed to carry out different tasks, for example. For example, one of these robots 4 can check in the travel direction only the left side of the tracks 1 and the second robot only the right side of the tracks 1 in the travel direction etc.

The carriage 2 is designed such that, when traveling alone, it can be moved on the tracks 1. At steep track sections, the brakes are actuated in such a way that the wheels 3 of the carriage 2 will not slip on the tracks 1 but will properly roll thereon. In this way, it is ensured that the position of the carriage 2 and thus of the robot 4 within the roller coaster is precisely determined.

The carriage 2 can also be one of the regular passenger cabins; the robot 4 is then present as a dummy. In this way, testing can be carried out during regular operation of the roller coaster.

The specification incorporates by reference the entire disclosure of German priority document 10 2006 010 110.3 having a filing date of Feb. 28, 2006.

While specific embodiments of the invention have been shown and described in detail to illustrate the inventive principles, it will be understood that the invention may be embodied otherwise without departing from such principles.

What is claimed is:

1. A testing device for roller coaster tracks, the testing device comprising:

a carriage adapted to move along tracks of a roller coaster;

at least one multi-axis robot mounted on the carriage and comprising at least one track testing element that examines a state of the tracks.

2. The testing device according to claim 1, wherein the at least one robot has at least six axes.

3. The testing device according to claim 1, wherein the at least one robot is rotatably supported on the carriage on an axis that is transverse to a plane of the tracks.

4. The testing device according to claim 3, wherein the axis is perpendicular to the plane of the tracks.

5. The testing device according to claim 1, wherein the at least one testing element is detachably connected to the least one robot.

6. The testing device according to claim 1, wherein several of the at least one testing element are supported on the carriage, wherein said several testing elements are selectively attachable to the at least one robot.

7. The testing device according to claim 6, further comprising a tool changer interacting with said several testing elements for attaching said several testing elements to the at least one robot.

8. The testing device according to claim 1, wherein the at least one testing element is rotatable about two axes positioned angularly to one another.

9. The testing device according to claim 8, wherein said two axes are positioned at a right angle to one another.

10. The testing device according to claim 1, wherein the at least one testing element is movable on a robot arm of the at least one robot.

11. The testing device according to claim 1, wherein the at least one robot has at least three robot arms that are adjustable relative to one another and extend angularly relative to one another.

12. The testing device according to claim 11, wherein said at least three robot arms are positioned at a right angle relative to one another.

13. The testing device according to claim 11, wherein said at least three robot arms are slidable relative to one another.

14. The testing device according to claim 11, wherein one of said at least three robot arms supports the at least one testing element and is movable into an area below and/or above the tracks.

15. The testing device according to claim 11, wherein one of said at least three robot arms is arranged in an area adjacent to the tracks.

16. The testing device according to claim 1, wherein the carriage comprises a braking device.

17. The testing device according to claim 1, wherein the carriage is operated autonomously or is operated remote-controlled.

18. The testing device according to claim 1, wherein the at least one robot is operated autonomously or is operated remote-controlled.

19. The testing device according to claim 1, wherein the at least one robot and the carriage are operated autonomously or are operated remote-controlled.

20. The testing device according to claim 1, wherein at least one of the carriage and the at least one robot is provided with a device for collision avoidance.

21. The testing device according to claim 1, wherein at least one of the carriage and the at least one robot is provided with at least one marking unit.

22. The testing device according to claim 1, wherein the at least one robot has a platform positionable by robot arms of the at least one robot.

* * * * *